US005852897A

United States Patent [19]

Sukale

[11] Patent Number: 5,852,897

[45] Date of Patent: Dec. 29, 1998

[54] DOOR DRIVE

[75] Inventor: Andreas Sukale, Berlin, Germany

[73] Assignee: Inventio AG, Hergiswil NW, Switzerland

[21] Appl. No.: 898,185

[22] Filed: Jul. 22, 1997

[30] Foreign Application Priority Data

Jul. 25, 1996 [EP] European Pat. Off. ..... 96810491

[51] Int. Cl.[6] ..... E05F 11/00

[52] U.S. Cl. ..... 49/358; 49/360; 310/67 R

[58] Field of Search ..... 49/360, 358, 425; 310/67 R

[56] References Cited

U.S. PATENT DOCUMENTS

| | | | |
|---|---|---|---|
| 826,367 | 7/1906 | Schroeder | 310/67 R X |
| 1,881,014 | 10/1932 | Ayers | 49/360 |
| 1,881,017 | 10/1932 | Jacobson | 49/360 X |
| 1,950,627 | 3/1934 | Darvin | 49/360 X |
| 1,986,639 | 1/1935 | Konn | 49/360 X |
| 2,303,263 | 11/1942 | Fisher | 49/360 X |
| 2,337,430 | 12/1943 | Trombetta | 49/360 X |
| 3,746,902 | 7/1973 | Hetzel | 310/67 R |
| 3,812,928 | 5/1974 | Rockwell et al. | 310/67 R X |
| 5,172,518 | 12/1992 | Yoshino | 49/360 |
| 5,301,468 | 4/1994 | Kamezaki | 49/225 |

FOREIGN PATENT DOCUMENTS

| | | | |
|---|---|---|---|
| 2151907 | 11/1972 | Germany | 49/360 |
| 384404 | 2/1965 | Switzerland . | |
| 636162 | 5/1983 | Switzerland | E05F 15/14 |

*Primary Examiner*—Jerry Redman
*Attorney, Agent, or Firm*—Schweltzer Corman Gross & Bondell LLP

[57] ABSTRACT

A friction wheel door drive for a sliding door for lifts consisting of at least one rectilinearly or curvilinearly moved door leaf (1), which is suspended of guide rollers (3) and is guided at a guide (2) is presented. At least one of the guide rollers (3) is formed as a motor roller (3') moving the door leaf and in the form of an outside rotor motor. The motor may be either a direct current motor with permanent magnets in the outside rotor and electronic commutation or a polyphase induction motor with a laminated outside rotor having a short-circuited winding and a laminated inner stator with a polyphase alternating current winding. Force transmission between the motor roller (3') and a running roller (3") may be provided by a transmission (18), between motor roller (3') and running roller (3") is possible.

9 Claims, 2 Drawing Sheets

DOOR DRIVE

The present invention relates to a friction wheel drive for a sliding door, especially for a lift door, consisting of at least one door leaf, which is moved rectilinearly or curvilinearly and which is supported by means of guide rollers and guided at a guide.

BACKGROUND OF THE INVENTION

A drive of the above-mentioned kind for door leaves of a sliding door is known by Swiss patent specification No. 636 162. This drive comprises a rotating shaft, which is parallel to the door guide, with at least one roller head, which operates as an entrainer of the door leaf suspended at a guide by means of guide rollers. The roller head comprises three rollers, which are distributed about the inner circumference of the roller head, and which are in frictionally-coupled connection with the rotating shaft. The roller axes are so arranged that when the shaft is rotating a lateral movement of the roller head on the shaft results in analogous motion of a screw nut on a rotating threaded spindle. Opposite movements of for example, two roller heads on the same shaft can be achieved with an appropriately different arrangement of the roller axes. The shaft itself is driven by a motor.

This drive does not particularly distinguish itself from conventional drives with either a crank drive or a belt drive from the viewpoint of construction and assembly cost. Moreover, for reasons of rigidity the rotating shaft must be supported at a plurality of points.

Swiss patent specification No. 384 404 describes a further "electrical drive device for opening and closing of lift doors". A drive similarly operating with a friction couple is shown in this disclosure, wherein the drive device works as a tractive drive, has a separate guide and the drive take-off thereof is formed as a conical friction wheel, which is disposed in operative connection with a special cam with chamfers at both sides. The chamfers effect an axial displacement of the friction contact point on the conical friction wheel, whereby a corresponding speed profile for the sliding door results from the cam geometry.

Due to the tractive drive principle, substantial space is needed for this drive, which precludes its use for lift applications. Furthermore, the friction contact with punctiform support seems to yield a somewhat limited friction couple.

It is therefore the task of the present invention to create a simple and compact friction wheel drive, which is economic to produce and universally usable, for a sliding door.

BRIEF DESCRIPTION OF THE INVENTION

The invention is distinguished inter alia in that the guide roller itself is constructed as a motor of the outside rotor form, thus as a motor roller. The outside rotor has the form of a guide roller which runs along on a guide rail. The outside rotor is mounted for rotation about a stationary shaft and is equipped with permanent magnets at its inner circumference. The stationary shaft is connected to the door leaf to be entrained, and carries a wound inner stator stack. The winding connections are guided outwardly through the interior of the shaft. The roller motor is advantageously realized as a permanent pole direct current motor with electronic commutation.

As a further type of motor, an synchronous polyphase induction motor with frequency regulation, can be used wherein the outside rotor then comprises an annular lamination stack with short-circuited squirrel cage and the static inner stator comprises a polyphase alternating current winding.

A feedback signal for speed regulation and travel regulation can be obtained by means of a revolution transmitter at the motor roller and/or linear transmitter at the guide each with a respective opto-electronic reader at the door leaf. A force transfer from a motor roller to a running roller is possible by means of a is transmission.

BRIEF DESCRIPTION OF THE DRAWINGS

The invention is more closely explained in the following by reference to an example of embodiment and is illustrated in the drawings, in which.

DETAILED DESCRIPTION OF THE INVENTION

Figure 1:
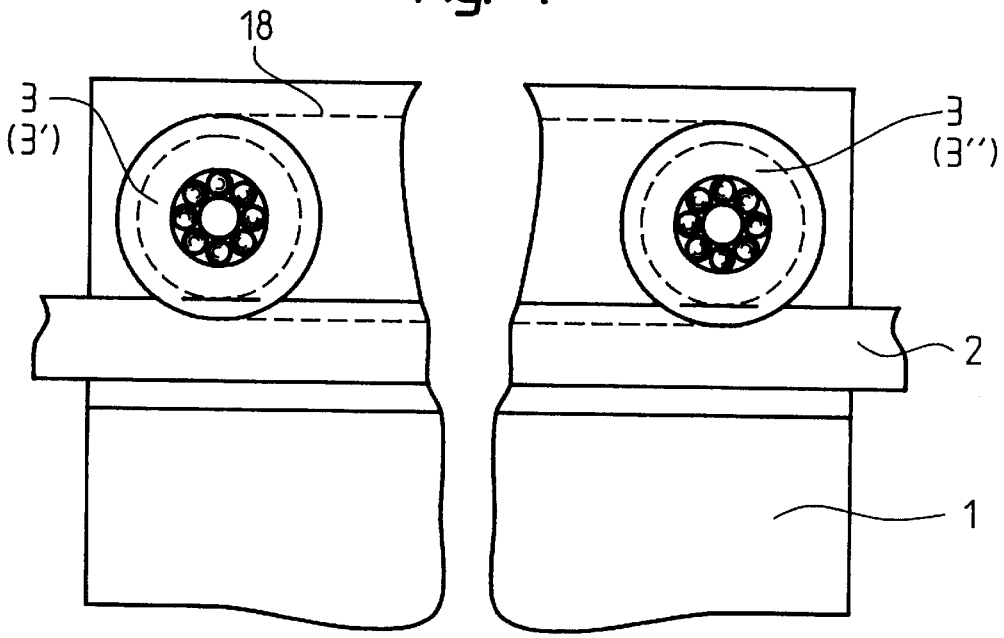
FIG. 1 shows the front view of a door leaf with motor roller and running roller.

A door leaf of a sliding door is designated by 1 in FIG. 1. The door leaf 1 is suspended by means of rollers 3 at a guide 2. Of the rollers 3, that designated by 3' is a motor roller, and that designated by 3" is a running roller. Externally, the difference between motor roller 3' and running roller 3" as seen from this side is not recognizable. Drawn in by dotted lines is a possible transmission cord 18 for transmission of the motor force from the motor roller 3' to a running roller 3".

Figure 2:
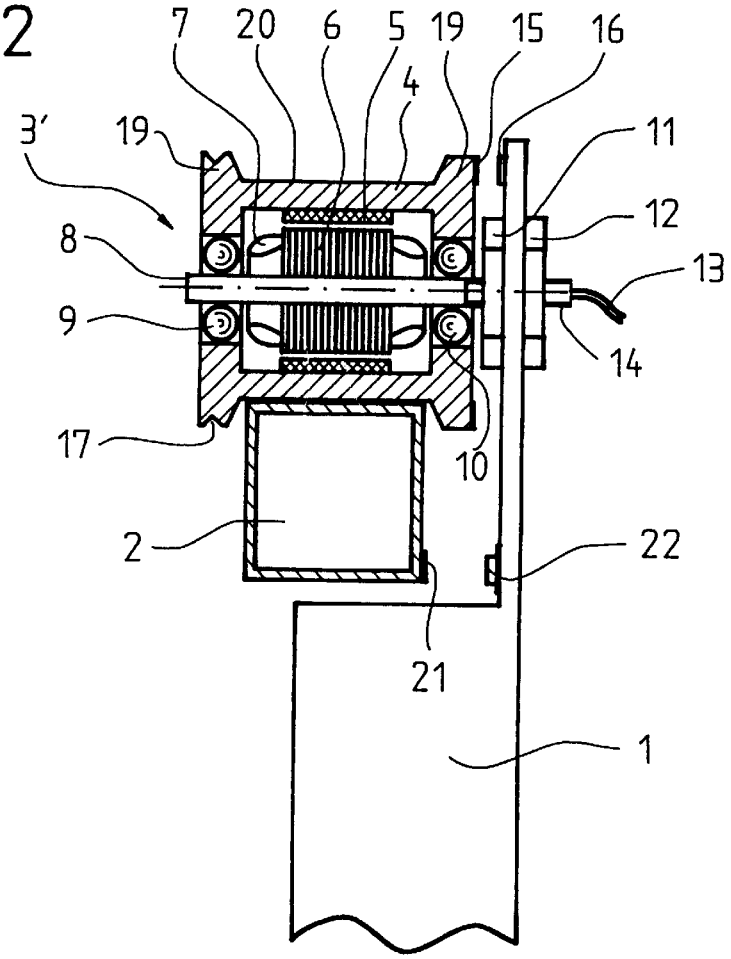
FIG. 2 shows a cross-section through a roller motor.

The roller 3' comprise a roller body with rim gear 19 at both ends and a running surface 20 is designated by 4 in FIG. 2. The forward rim gear 19 has a groove 17 for the laying in of the transmission cord 18. Respective roller bearings 9 and 10, each running on a stationary shaft 8, are incorporated in the forward and rearward end face of the roller body 4. In the illustrated exemplary form, the motor incorporated in the roller body 4 is a direct current motor with permanent magnet poles 5 upon the circumference of the inner cylindrical roller surface and a laminated inner stator 6 with a winding 7 on the stationary shaft 8, wherein an electronic commutator circuit, which is not illustrated, is provided instead of a mechanical commutator.

The right hand end part of the shaft 8 is provided with a screw thread 14 beyond the exit from the roller body 4. The shaft 8 is firmly screw-connected at the thread end with the upper part of the door leaf 1 by means of flat nuts 11 and 12. The winding connections 13 of the winding 7 are guided out through an axial bore in the shaft 8. For the purpose of signalling back the roller speed to a motor regulation regulator of known kind, a code strip 15 in a circularly annular form is mounted externally on the rearward end face of the roller body 4 and is electronically scanned by a reader 16, for example of a known opto-electronic-type, mounted on the door leaf 1. For the signalling back to a travel regulator of known kind a further code strip 21 is mounted on the guide 2 and is scanned by an analog reader 22, similarly preferably opto-electronic, on the door leaf.

Figure 3:
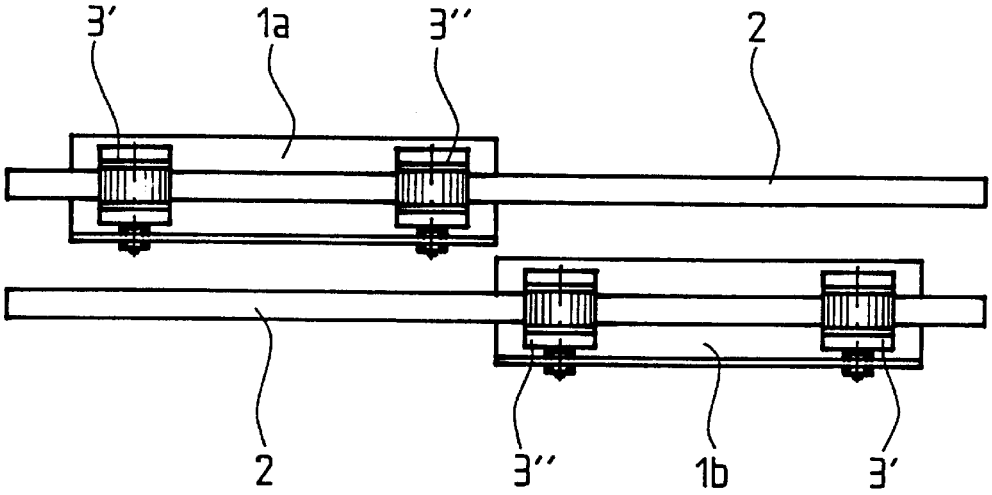
FIG. 3 shows a plan view of a telescopic sliding door with motor roller and running roller.

FIG. 3 is an example of use of the invention in connection with a telescopic door. In classic mechanical drives having an entraining lever, different speeds for the two door leaves 1*a* and 1*b* is achieved through different lever translations and is thus unchangeably defined. With the individual controllable and regulable motor rollers 3', as depicted in FIG. 3, the first speed of the door leaf 1*a* and a second, typically double speed of the door leaf 1*b* can be preset solely by the motor control and regulating devices. As an alternative, the roller motors in the two motor rollers 3' may be constructed to be appropriately different, for example with respect to the number of poles, whereby the precise movement synchronization or movement relationship of the two door leaves 1*a* and 1*b* relative to one another can be additionally monitored by the two travel and speed regulators associated with the door leaves 1*a* and 1*b*.

The power requirements for the door drive varies according to the respective mass and required speed of the sliding door. A doubling of the drive power can be accommodated, for example, by utilizing motor rollers 3' for both door rollers for a particular door leaf. In the case of very light door leaves the drive power of a motor roller 3' can additionally be transmitted to a running roller by a cord 18, whereby the friction coupling with the guide 1 is improved. Moreover, the running surface 20 of a motor roller 3' can also be provided with a coating having a higher friction value, whereby the friction couple with the guide is similarly strengthened.

Figure 4:
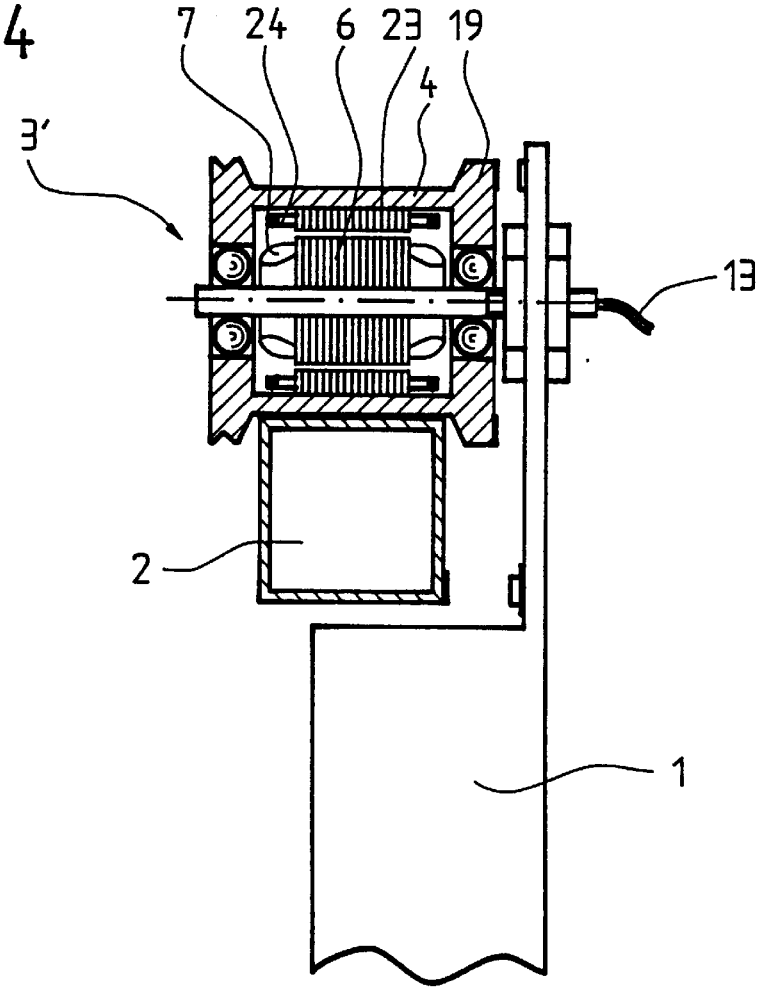
FIG. 4 shows the roller motor as a three-phase induction synchronous motor.

An synchronous polyphase induction motor can be provided as depicted in FIG. 4. If such a motor is incorporated into the roller body 4, it may consist of a lamination stack outside rotor 23 with a short circuit winding 24 consisting of short-circuit rods pushed into grooves and short-circuit rings connected at the end faces with the short-circuit rods. A similarly laminated inner stator on the shaft 8 includes a known polyphase winding with, for example, two or more poles formed by the winding layout. Control and regulation of such a polyphase induction motor can be expediently effected by means of a variable voltage, frequency and amplitude control, as known in the art.

Other modifications and adaptations to the invention a described herein are intended to be embraced thereby. For example, the profile of the door roller 2 is not limited to that of the shown example. Concave or convex running surfaces, which then run on guides with a correspondingly matched shape, can also be employed. Instead of a cord 18, the use of a light chain or a flat belt is also possible. The latter can run on the running surface 20 and thus replace an additional friction coating. In such a case, however, one of the door rollers should be fastened in an elongate hole or a slot, or provided with other adjustment means, for the tensioning of the belt.

I claim:

1. A friction wheel door drive in combination with a sliding door having at least one door leaf which is moved along a path and which is suspended by means of guide rollers and guided at a guide, characterized in that at least one of the guide rollers is constructed as a motor roller which entrains the door leaf, the motor roller having an internal motor with an outside rotor comprising a roller body and an inner stator having an axle connected to one of said at least one door leaves.

2. The door drive according to claim 1, characterized in that the motor of the motor roller is constructed as a direct current motor with electronic commutation, wherein the outside rotor comprises permanent magnets arranged at an inner circumference of the roller body, and the inner stator further comprises a lamination stack having a winding fastened to the axle.

3. The door drive according to claim 1, characterized in that the motor is constructed as a polyphase induction synchronous motor, wherein the outside rotor comprises an annular lamination stack having a short-circuited winding and the inner stator further comprises a lamination stack having a polyphase alternating current winding fastened to the axle.

4. The door drive according to claim 1, characterized in that the motor roller comprises a revolution transmitter with a code strip associated with the motor roller and a reader associated with the door leaf.

5. The door drive according to claim 4, further characterized in that the motor roller comprises a linear transmitter with a code strip associated with the guide and a reader associated with the door leaf.

6. The door drive according to claim 1, further characterized in that the motor roller comprises a linear transmitter with a code strip associated with the guide and a reader associated with the door leaf.

7. The door drive according to claim 1, characterized in that a transmission for force transfer from the motor roller to a running roller is provided between the motor roller and a running roller.

8. The door drive according to claim 7 further characterized in that the transmission comprises a cord and the motor roller body includes a grooved rim gear to accept the cord.

9. The door drive according to claim 7 further characterized in that the roller body of the motor roller has a running surface, said transmission comprising a flat belt mounted on the running surface and a running surface for the running roller.

* * * * *